US007731543B2

(12) United States Patent
Aoki et al.

(10) Patent No.: US 7,731,543 B2
(45) Date of Patent: Jun. 8, 2010

(54) SHIELDED CONNECTOR

(75) Inventors: Eiji Aoki, Makinohara (JP); Tomokazu Yamane, Makinohara (JP); Takeaki Kaneko, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/212,746

(22) Filed: Sep. 18, 2008

(65) Prior Publication Data

US 2009/0093157 A1 Apr. 9, 2009

(30) Foreign Application Priority Data

Oct. 3, 2007 (JP) ..... 2007-259570

(51) Int. Cl.
*H01R 13/04* (2006.01)

(52) U.S. Cl. ..... 439/697; 439/686

(58) Field of Classification Search ..... 439/696, 439/697, 695, 686, 687, 701, 607
See application file for complete search history.

(56) References Cited

U.S. PATENT DOCUMENTS

| | | | | |
|---|---|---|---|---|
| 4,337,989 | A * | 7/1982 | Asick et al. | 439/607.23 |
| 5,007,862 | A * | 4/1991 | Defibaugh et al. | 439/607.59 |
| 5,180,316 | A * | 1/1993 | Miller et al. | 439/607.5 |
| 6,142,828 | A * | 11/2000 | Pepe | 439/607.43 |
| 6,805,590 | B2 * | 10/2004 | Kato | 439/638 |
| 7,195,518 | B2 * | 3/2007 | Bert et al. | 439/607.43 |
| 2005/0239341 | A1 * | 10/2005 | Tamura et al. | 439/686 |

FOREIGN PATENT DOCUMENTS

JP 2007-103177 A 4/2007

* cited by examiner

*Primary Examiner*—Hien Vu
(74) *Attorney, Agent, or Firm*—Sughrue Mion, PLLC

(57) ABSTRACT

A shielded connector includes: a housing having a terminal cavity and a flexible locking portion; and a shielded shell having a wire inserting hole and an engaging hole engaged with the flexible locking portion. The flexible locking portion is arranged on at least an upper portion of an outer edge of the housing. The housing includes a restricting rib for restricting a displacement of the flexible locking portion.

9 Claims, 7 Drawing Sheets

SHIELDED CONNECTOR

BACKGROUND OF THE INVENTION

1. Field of the Invention

The present invention relates to a shielded connector integrating a shielded shell to a housing containing a terminal of a terminal-attached wire.

2. Background Art

There is known a shielded connector 70 including a housing 71 having an opening portion 72 and having an engaging portion 74 in a shape of a stepped difference at a rear end of a recess portion 73 of a side portion thereof, and a shielded shell 75 in a shape of a square cylinder having locking portions 76 convex to an inner side at both side portions and having notched portion 77 at upper side two corner portions, and having a projected portion 78 between the notched portions 77 (refer to, for example, JP-A-2007-103177 (FIG. 1)).

According to the shielded connector 70, a terminal 80 of a wire 79 is contained in the housing 71, the housing 71 is inserted to the shielded shell 75 by positioning the projected portion 78 of the shielded shell 75 to the opening portion 72 of the housing 71, the locking portions 76 of the shielded shell 75 are engaged with the engaging portions 74 of the housing 71, thereby, the shielded shell 75 is integrated to the housing 71 by covering an outer periphery thereof, and a ring member 81 and a knitted tube 82 are integrated to the shielded shell 75.

However, according to the shielded connector 70 disclosed in JP-A-2007-103177, the metal-made shielded shell 75 is fixed to the housing 71 by the locking portion 76 which is formed by being cut to raise, and therefore, in integrating the resin-made housing 71, the locking portion 76 is easy to be deformed, and when the locking portion 76 is deformed, there is a concern of detaching the shielded shell 75 from the housing 71 since a sufficient locking force cannot be maintained.

In addition thereto, in engaging the engaging portion 76 of the shielded shell 75 with the engaging portion 74 of the housing 71, since the locking portion 76 and the engaging portion 74 are arranged at the side portions of the shielded shell 75 and the housing 71, positioning is difficult to be carried out and an integrating performance is not excellent.

SUMMARY OF THE INVENTION

The invention has been carried out in view of the above-described problem and it is an object thereof to provide a shielded connector capable of maintaining a sufficient locking force and having an excellent integrating performance.

The above-described object of the invention is achieved by the following constitution.

According to the invention, there is provided a shielded connector, including: a housing having a terminal cavity and a flexible locking portion; and a shielded shell having a wire inserting hole and an engaging hole engaged with the flexible locking portion, wherein the flexible locking portion is arranged on at least an upper portion of an outer edge of the housing; and wherein the housing includes a restricting rib for restricting a displacement of the flexible locking portion.

According to the shielded connector having the above constitution, the flexible locking portion is arranged at a position of the outer edge portion of the housing which is optically recognizable, and the restricting rib is arranged on an inner side in a direction of bending the flexible locking piece. Thereby, in comparison with the shielded connector arranged with the locking portion at the side portion of the housing as in the background art, an operator can simply position the flexible locking portion and the engaging hole, and therefore, positioning is easy to carry out and the integrating performance is improved.

Further, when an external force is exerted to the shielded shell, the restricting rib restricts the displacement of the flexible locking portion of the housing, and therefore, the force of locking the flexible locking portion to the locking hole is not deteriorated. Thereby, the sufficient force of locking the flexible locking portion to the engaging hole can be maintained.

Preferably, the flexible locking portion is provided to be bent to deform in an inner direction of the connector, and the restricting rib is arranged on an inner side of the flexible locking portion.

Preferably, the restricting rib includes an inner portion arranged on an inner side of the flexible locking portion and a side portion extending from the inner portion to surround three sides of the flexible locking portion.

According to the shielded connector of the above constitutions, the sufficient locking force can be maintained by preventing the flexible locking portion from being bent more than necessary in the inner direction by an external force exerted to the shielded shell.

Preferably, the flexible locking portion is provided to be bent to deform in an outer direction of the connector, and the restricting rib is arranged on an outer side of the flexible locking portion.

Preferably, the restricting rib includes an outer portion arranged on an outer side of the flexible locking portion and a side portion extending from the outer portion to surround three sides of the flexible locking portion.

According to the shielded connector of the above constitutions, the sufficient locking force can be maintained by preventing the flexible locking portion from being bent more than necessary in the outer direction by the external force exerted to the shielded shell.

Preferably, the restricting rib is formed to be contact at least a part of a lip of the engaging hole.

According to the shielded connector of the above constitution, by bringing the restricting rib into contact with at least a part of a frame of the engaging hole, a structure of engaging the flexible locking portion with the engaging hole while the housing is being supported by the restricting rib is constructed and a rigidity of integrating the housing and the shielded shell can be promoted.

According to the invention, in the shielded connector including the housing having the terminal cavity and having the flexible locking portion, and the shielded shell having the wire inserting hole and the engaging hole engaged with the flexible locking portion, a shielded connector capable of maintaining a sufficient locking force and having an excellent integrating performance can be provided.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A plurality of preferable embodiments according to the invention will be explained in details in reference to the drawings as follows.

First Embodiment

Figure 1:
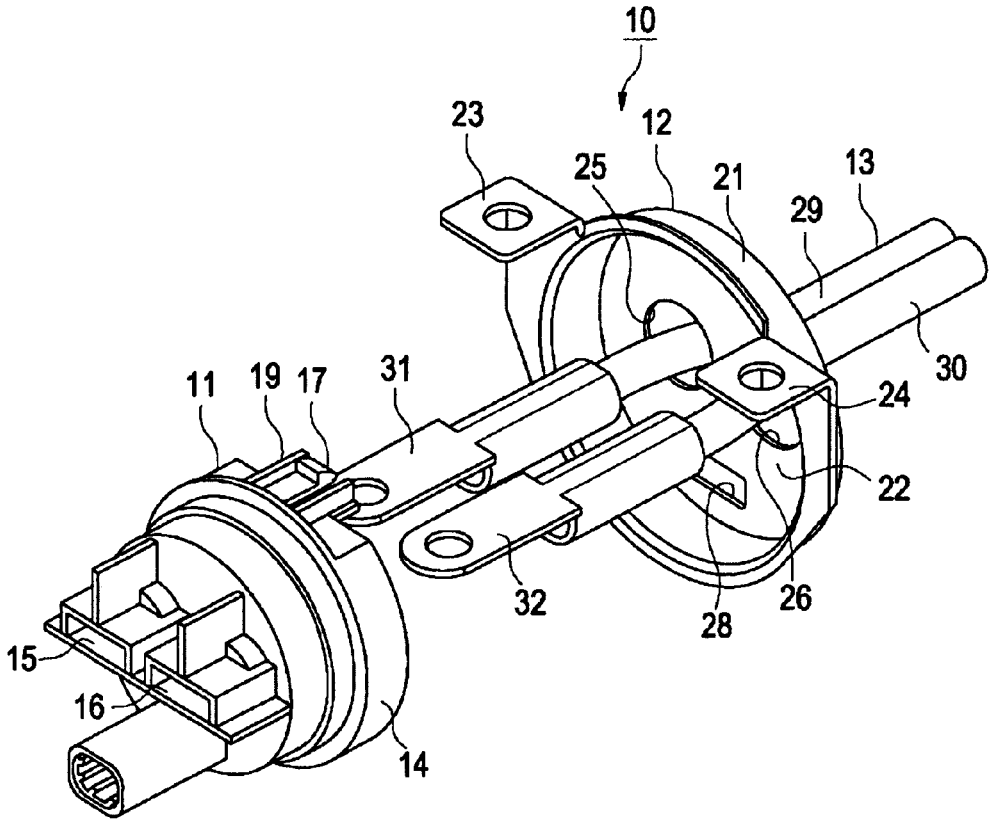
FIG. 1 is a disassembled perspective view viewed from a side of a housing in a shielded connector according to a first embodiment of the invention.
Figure 2:
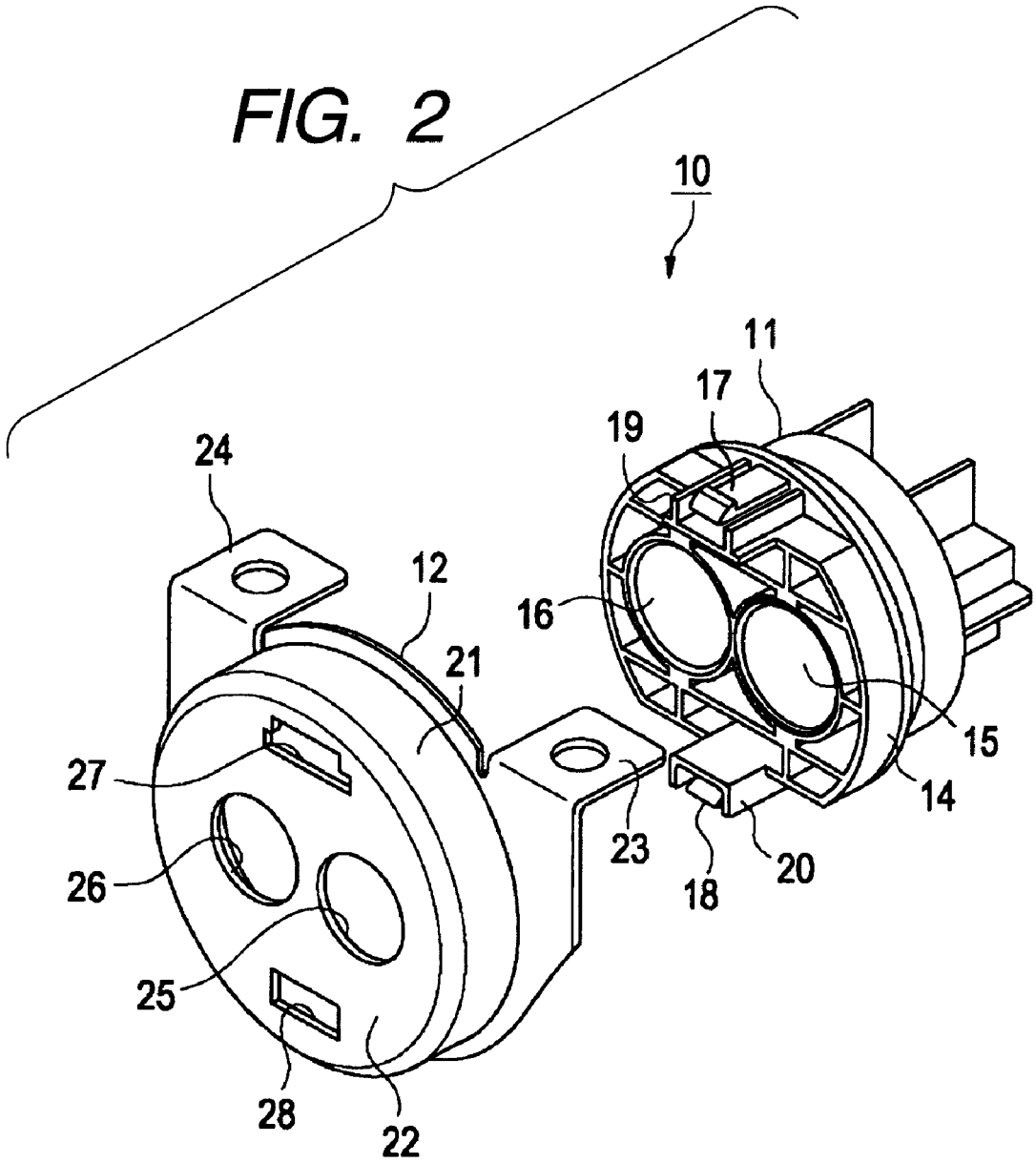
FIG. 2 is a disassembled perspective view viewed from a side of a shielded shell in the shielded connector of FIG. 1.
Figure 3:
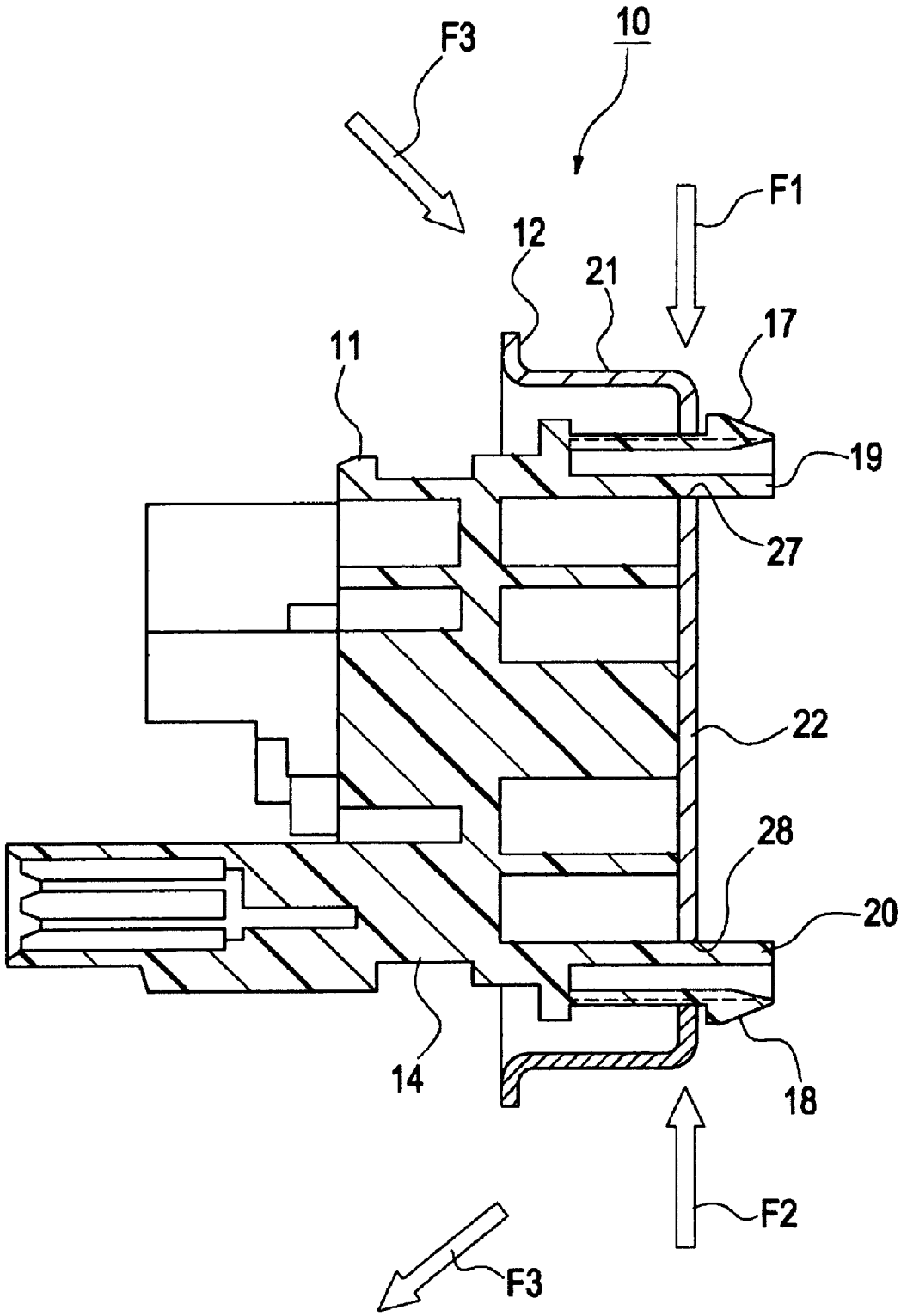
FIG. 3 is a vertical sectional view after integrating the shielded connector of FIG. 1.

FIG. 1 through FIG. 3 show a first embodiment of a shielded connector according to the invention, FIG. 1 is a disassembled perspective view viewed from a side of a housing of a shielded connector according to a first embodiment of the invention, FIG. 2 is a disassembled perspective view viewed from a side of a shielded shell of the shielded connector of FIG. 1, and FIG. 3 is a vertical sectional view after integrating the shielded connector of FIG. 1

As shown by FIG. 1, a shielded connector 10 according to a first embodiment of the invention includes a housing 11, a shielded shell 12, and a terminal-attached wire 13, and a knitted conductor, not illustrated, is electrically connected to the shielded shell 12.

The housing 11 is made to function as a male connector housing and includes a housing main body 14 formed in a shape of a circular pillar by using an insulating resin.

The housing 11 is penetrated to form in parallel with a pair of terminal cavities 15 and 16 in which one end portions thereof constituting a side of a female connector housing, not illustrated, constitute a shape of a quadrangular hole, and other end portions constituting a counter female connector housing side constitute a circular hole shape.

Further, at an outer edge of other end portion of the housing main body 14, a first flexible locking piece (flexible locking portion) 17 arranged at an upper portion thereof and a second flexible locking piece (flexible locking portion) 18 (refer to FIG. 2) arranged at a lower portion opposed to the first flexible locking piece 17 are respectively projected to be formed from the housing main body 14 in an axial direction.

The first flexible locking piece 17 is formed by a shape of a hook, and a side of a front end portion thereof is made to be flexible to bend to deform in an inner direction of the housing main body 14.

Further, a vicinity of the first flexible locking piece 17 is formed with a first restricting rib 19, and a vicinity of the second flexible locking piece 18 is formed with a second restricting rib 20 (refer to FIG. 2). The first restricting rib 19 is constituted by a channel-like shape surrounding three sides of a lower side (inner side of the housing 11) and both sides excluding an upper side of the first flexible locking piece 17 and is formed to project in a direction the same as that of the first flexible locking piece 17 from the housing main body 14.

The first restricting rib 19 is not bent to deform different from the first flexible locking piece 17, and therefore, the first restricting rib 19 is provided with a function for preventing the first flexible locking piece 17 from being bent to an inner direction constituting the bending direction by exceeding a previously determined amount by being brought into contact therewith.

The shielded shell 12 is formed by a shape of a bottomed circular ring by using a metal having a conductivity and includes a side plate 22 in correspondence with a bottom on a side of a circular ring portion 21 opposed to the housing 11. The shielded shell 12 forms a grounding circuit for preventing a disturbance or the like by electrically connecting a knitted conductor thereto.

The shielded shell 12 respectively includes fixing portions 23 and 24 in a shape of a flange extended in an upper direction at both side portions of the circular ring portion 21.

Further, the shielded shell 12 is penetrated to form in parallel with a pair of wire inserting holes 25 and 26 constituting a shape of a round hole at a center portion in an up and down direction of the side plate 22, a first engaging hole (refer to FIG. 2) 27 is penetrated to form on upper sides of the wire inserting holes 25 and 26 and penetrated to form a second engaging hole 28 constituting a shape of square hole is penetrated to form on lower sides thereof. The first engaging hole 27 constitutes a shape of a T-like square hole.

According to the terminal-attached wire 13, male terminals 31 and 32 are respectively electrically connected to end portions of wires 29 and 30.

As shown by FIG. 2, the second flexible locking piece 18 is formed at a lower portion of an outer edge portion of other end portion of the housing main body 14. The second flexible locking piece 18 is constituted by an outer shape the same as that of the first flexible locking piece 17 and formed in a shape of a symmetrical hook and a side of a front end portion thereof is made to be bent to deform in the inner direction of the housing main body 14.

Further, a vicinity of the second flexible locking piece 18 is formed with the second restricting rib 20. The second restricting rib 20 is constituted by a channel-like shape surrounding three sides of an upper side (lower side of the housing 11) and both sides excluding a lower side of the second flexible locking piece 18 and is formed to project in a direction the same as that of the second flexible locking piece 18 from the housing main body 14.

The second restricting rib 20 is not bent to deform different from the second flexible locking piece 18, and therefore, the second restricting rib 20 is provided with the function of preventing the second flexible locking piece 18 from being bent by exceeding a previously determined amount in the inner direction constituting the bending direction by being brought into contact therewith.

In integrating the shielded connector 10, the terminal-attached wire 13 is integrated to the housing 11 by passing through the wire inserting holes 25 and 26 of the shielded shell 12 by constituting a preceding side thereof by the male terminals 31 and 32 and respectively inserting the male terminals 31 and 32 into the terminal cavities 15 and 16 of the housing 11 to be locked thereby.

Next, by pressing the housing 11 to the shielded shell 12, the first flexible locking piece 17 and the first restricting rib 19 of the housing 11 are inserted to the first engaging hole 27 of the shielded shell 12 and the first flexible locking piece 17 is engaged with the first engaging hole 27. Simultaneously therewith, at a position opposed to the first flexible locking piece 17, the second flexible locking piece 18 and the second restricting rib 20 of the housing 11 are inserted to the second engaging hole 28 of the shielded shell 12 and the second flexible locking piece 18 is engaged with the second engaging hole 28, and the housing main body 14 of the housing 11 is brought into contact with the side plate 22 of the shielded shell 12.

At this occasion, the first restricting rib 19 is brought into contact with a lower portion and both side portions of the first engaging hole 27, and the first flexible locking piece 17 is engaged with an upper portion of the first engaging hole 27 by an elastic repulsion force accumulated by itself. Further, the second restricting rib 20 is brought into contact with an upper portion and both side portions of the second engaging hole 28, and the second flexible locking piece 18 is engaged with a lower portion of the second engaging hole 28 by an elastic repulsion force accumulated by itself.

Further, it is not necessary to position the housing 11 and the shielded shell 12 by respectively positioning the two flexible locking pieces 17 and 18 and the two engaging holes 27 and 28 since the first flexible locking piece 17 arranged at the upper portion can optically be confirmed and simple operation of only matching the first flexible locking piece 17 to the first engaging hole 27 is constituted.

As shown by FIG. 3, when the shielded connector 10 integrated by engaging the two flexible locking pieces 17 and 18 to the two engaging holes 27 and 28 is fixed to a vehicle body panel, a junction box or the like, not illustrated, by a bolt or the like by way of the fixing portions 13 and 14, thereafter, for example, an external force F1 directed from an upper side to a lower side of FIG. 3 is exerted to the shielded shell 12, since amounts of bending the two flexible locking pieces 17 and 18 are restricted by the two restricting ribs 19 and 20, forces of locking the two flexible locking pieces 17 and 18 to the two engaging holes 27 and 28 are maintained and detachment thereof is not brought about.

This is because even when the shielded shell 12 is applied with a stress directed to the lower side of FIG. 3 by the external force F1, the second restricting rib 20 inserted to the second engaging hole 28 and brought into contact with the upper portion of the second engaging hole 28 is not made to deform and the second flexible locking piece 18 is not bent by receiving the stress.

Different therefrom, when the shielded shell 12 is exerted with, for example, an external force F2 directed from a lower side to an upper side of FIG. 3, since amounts of bending the two flexible locking pieces 17 and 18 are restricted by the two restricting ribs 19 and 20, forces of locking the two flexible locking pieces 17 and 18 to the two engaging holes 27 and 28 are maintained and detachment is not brought about. This is because even when a stress directed to the upper side of FIG. 3 is applied to the shielded shell 12 by the external force F2, the first restricting rib 19 inserted to the first engaging hole 27 and brought into contact with the lower portion of the first engaging hole 27 is not bent to deform and the first flexible locking piece 17 is not bent by receiving the stress.

Further, according to the shielded connector 10, by arranging the two flexible locking pieces 17 and 18 on at least the upper portion constituting a position optically recognizable at the outer edge portion of the housing 11 and arranging the two restricting ribs 19 and 20 to the inner sides in the directions of bending the two flexible locking pieces 17 and 18, in comparison with the connector arranging the locking portion at the side portion of the housing as in the background art, an operator can simply carry out positioning, positioning is easy to be carried out and an integration performance is improved, the two flexible locking pieces 17 and 18 are not bent to the inner sides by the external forces F1 and F2 exerted to the shielded shell 12 and sufficient locking force can be maintained. In this case, the inner side indicates a center side of the housing body 14.

Further, according to the shielded connector 10, by bringing the two restricting ribs 19 and 20 into contact with the side portions of the two flexible locking pieces 17 and 18, a structure of engaging the two flexible locking pieces 17 and 18 with the two engaging holes 27 and 28 while supporting the housing 11 by the two restricting ribs 19 and 20 can be constructed and a rigidity of integrating the housing 11 and the shielded shell 12 can be promoted.

Second Embodiment

Figure 4:
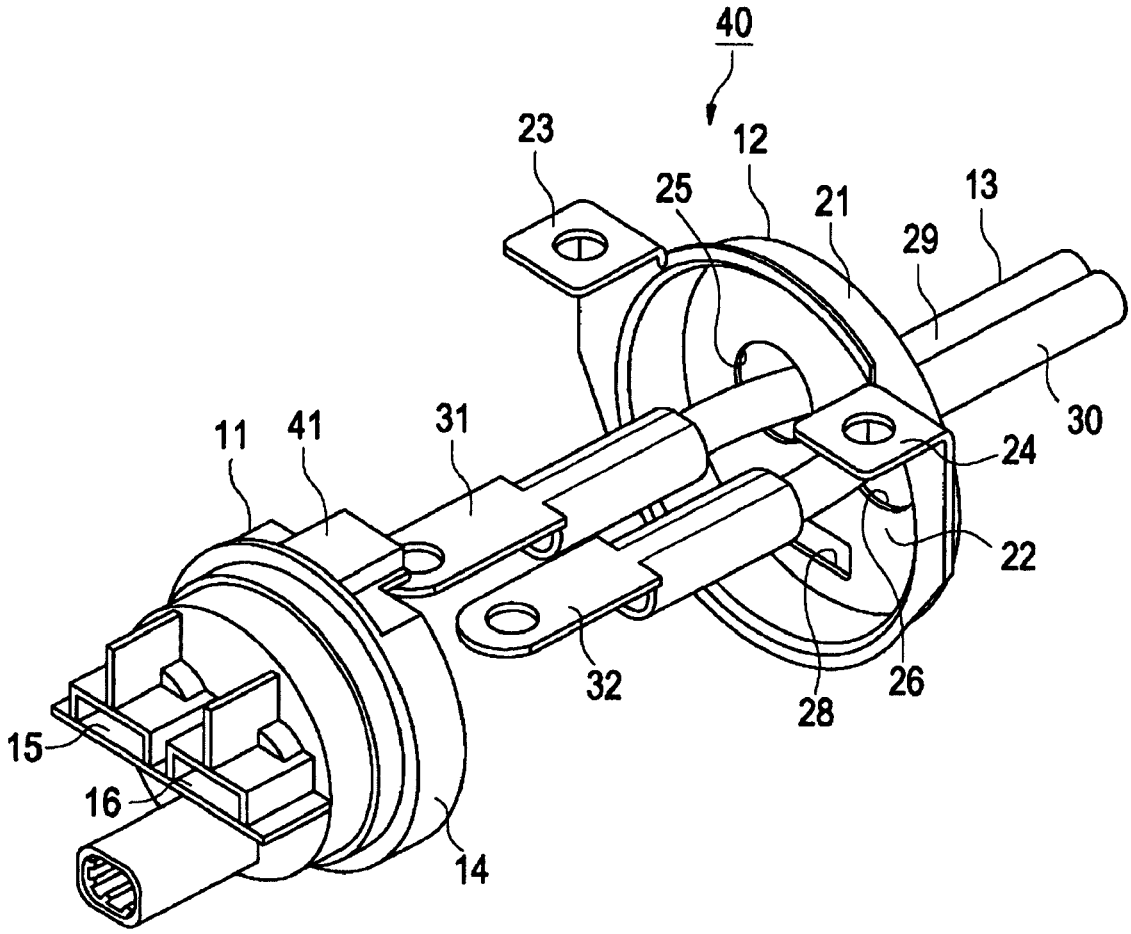
FIG. 4 is a disassembled perspective view viewed from a side of a housing in a shielded connector according to a second embodiment of the invention.
Figure 5:
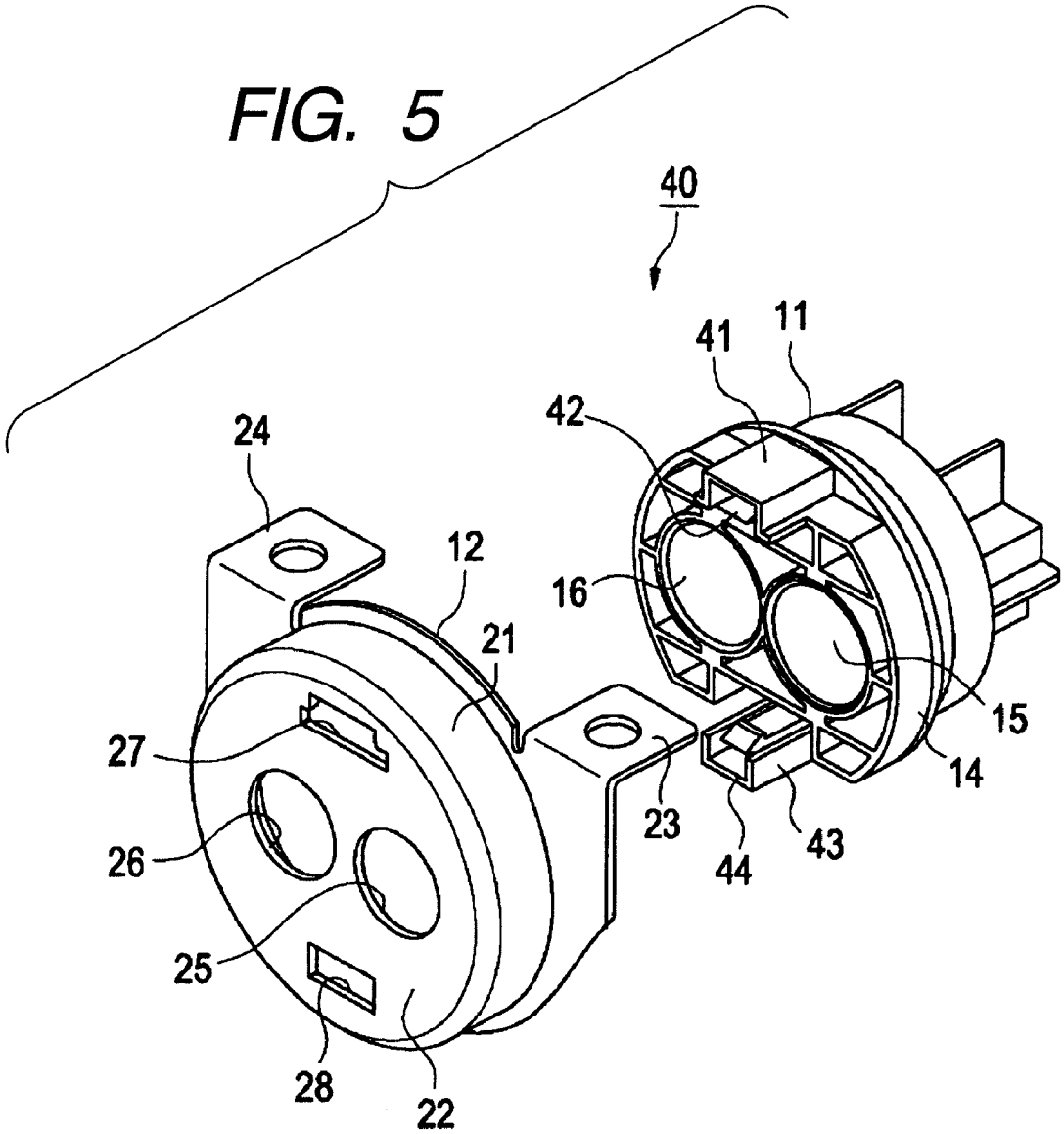
FIG. 5 is a disassembled perspective view viewed from a side in a shielded shell of the shielded connector of FIG. 4.
Figure 6:
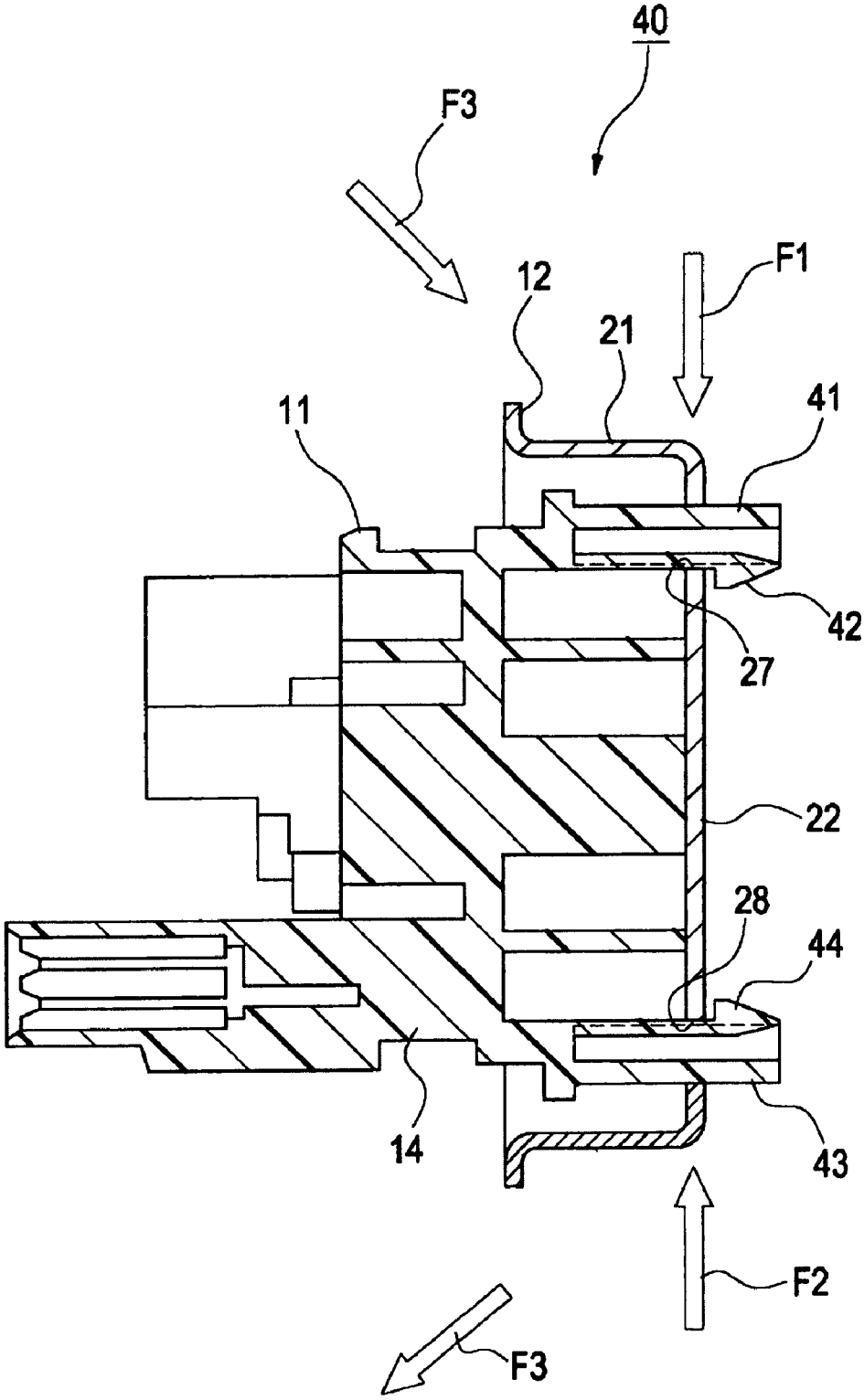
FIG. 6 is a vertical sectional view after integrating the shielded connector of FIG. 4.
Figure 7:
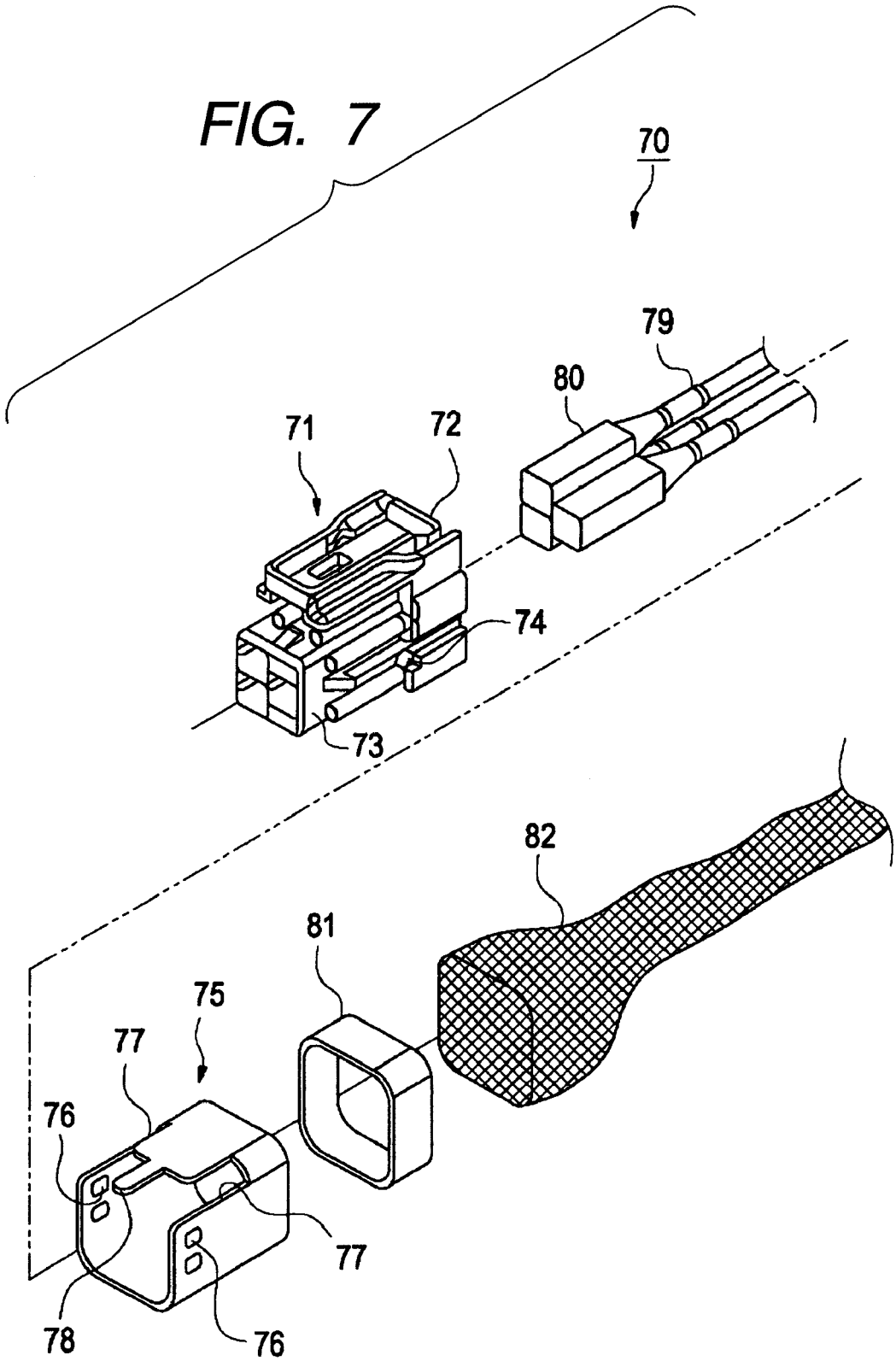
FIG. 7 is an outlook view of a shielded connector of a background art.

Next, a shielded connector of a second embodiment according to the invention will be explained in reference to FIG. 4 through FIG. 6. FIG. 4 through FIG. 6 show a second embodiment of a shielded connector according to the invention, FIG. 4 is a disassembled perspective view viewed from a side of a housing of the shielded connector according to the second embodiment of the invention. FIG. 5 is a disassembled perspective view viewed from a side of a shielded shell of the shielded connector of FIG. 4, and FIG. 6 is a vertical sectional view after integrating the shielded connector of FIG. 4. Further, in the second embodiment, an explanation of constituent portions common to those of the above-described first embodiment are simplified or omitted by attaching the same notations or corresponding notations.

As shown by FIG. 4 and FIG. 5, a shielded connector 40 is arranged with a first restricting rib 41 on an outer side in a direction of bending a first flexible locking piece 42 and a second restricting rib 43 is arranged on an outer side in a direction of bending a first locking piece 44.

The first restricting rib 41 is formed to project in a direction the same as that of the first flexible locking piece 42 from the housing main body 14 by constituting a channel-like shape surrounding three sides of an upper side (outer side of the housing body 14) and both sides excluding a lower side of the first flexible locking piece 42.

The first restricting rib 41 is provided with a function of preventing the first flexible locking piece 42 from being bent by exceeding a previously determined amount in an upper direction constituting the bending direction by being brought into contact therewith so as not to be bent to deform different from the first flexible locking piece 42.

The second restricting rib 43 is formed to project in a direction the same as that of the second flexible locking piece 44 from the housing main body 14 by constituting a channel-like shape of surrounding three sides of a lower side (outer side of the housing body 14) and both sides excluding an upper side of the second flexible locking piece 44.

The second restricting rib 43 is provided with the function of preventing the second flexible locking piece 44 from being bent by exceeding a previously determined amount in a lower direction constituting the bending direction by being brought into contact therewith so as not to be bent to deform different from the second flexible locking piece 44.

After integrating the shielded connector 40, the first restricting rib 41 is brought into contact with the upper portion and both side portions of the first engaging hole 27, and the first flexible locking piece 42 is engaged with a lower portion of the first engaging hole 27 by an elastic repulsion force accumulated by itself. Further, the second restricting rib 43 is brought into contact with a lower portion and both side portions of the second engaging hole 28 and the second flexible locking piece 44 is engaged with the upper portion of the second engaging hole 28 by an elastic repulsion force accumulated by itself.

As shown by FIG. 6, when the shielded shell 12 is exerted with, for example, an external force F1 directed from an upper side to a lower side of FIG. 6, even when a stress directed to the lower side of FIG. 6 is applied to the shielded shell 12 by the external force F1, the first restricting rib 41 inserted to the first engaging hole 27 and brought into contact with the upper portion of the first engaging hole 27 is not bent to deform, the first flexible locking piece 42 is not bent by receiving the stress, and therefore, forces of locking the two flexible locking pieces 42 and 44 to the two engaging holes 27 and 28 are maintained and detachment is not brought about.

Different therefrom, when the shielded shell 12 is exerted with, for example, an external force F2 directed from the lower side to the upper side of FIG. 6, even when a stress directed to the upper side of FIG. 6 is applied to the shielded shell 12 by the external force F2, the second restricting rib 43 inserted to the second engaging hole 28 and brought into contact with the lower portion of the second engaging hole 28 is not bent to deform, the second flexible locking piece 44 is not bent by receiving the stress, and therefore, forces of locking the two flexible locking pieces 42 and 44 to the two engaging holes 27 and 28 are maintained and detachment is not brought about.

Further, according to the first embodiment, there is a concern of detaching the flexible locking piece 42 from the first engaging hole 27 by excessively bending to deform the flexible locking piece 42 by rotating the shielded shell 12 right-handedly when an external force F3 directed to a skewed lower side is exerted. However, according to the second embodiment, even when the shielded shell 12 is rotated right-handedly by exerting the external force F3 in a skewed lower direction in FIG. 6, the first restricting rib 41 is not bent, and therefore, forces of locking the two flexible locking pieces 42 and 44 to the two engaging holes 27 and 28 are maintained and detachment is not brought about.

The shielded connector 40 of the second embodiment achieves operation and effect similar to those of the above-described first embodiment, according to the shielded connector 40 of the second embodiment, by arranging the two flexible locking pieces 42 and 44 at optically recognizable positions of the outer edge portions of the housing 11 and arranging the two restricting ribs 41 and 43 on the outer sides in the directions of bending the two flexible locking pieces 42 and 44, in comparison with a shielded connector arranged with the locking portion at the side portion of the housing as in the background art, an operator can simply carry out positioning, and therefore, positioning is easy to be carried out and an integrating performance is improved, and sufficient locking force of preventing the two flexible locking pieces 42 and 44 from being bent to the outer sides by the external forces F1 and F2 exerted to the shielded shell 12 can be maintained. In this case, the outer side indicates a periphery side of the housing body 14.

Further, the invention is not limited to the above-described embodiments, but can pertinently be modified, or improved. Otherwise, materials, shapes, dimensions, numerical values, modes, numbers, arranging locations and the like of respective constituent elements of the above-described embodiments are arbitrary and not limited so far as the object of the invention can be achieved.

For example, the flexible locking pieces are not limited to a pair thereof, illustrated, and may be constituted by a plurality of pairs thereof. Naturally, it is preferable in that case, that the restricting ribs are provided for the respective flexible locking pieces.

Further, the restricting rib may be formed by a shape of a flat plate which is not bent to deform in place of the restricting rib formed by the channel-like shape, illustrated.

What is claimed is:

1. A shielded connector, comprising:

a housing having a terminal cavity and a flexible locking portion; and a shielded shell having a wire inserting hole and an engaging hole into which the flexible locking portion is received and engaged, wherein the flexible locking portion is arranged on at least an upper portion of an outer edge of the housing; and wherein the housing includes a restricting rib having a portion extended outwardly from the housing and adjacent to the flexible locking portion for restricting a displacement of the flexible locking portion, the restricting rib also being received in the engaging hole.

2. The shielded connector according to claim 1, wherein the flexible locking portion is provided to be bent to deform in an inner direction of the connector, and wherein the restricting rib is arranged on an inner side of the flexible locking portion.

3. The shielded connector according to claim 2, wherein the restricting rib includes an inner portion arranged on an inner side of the flexible locking portion and a side portion extending from the inner portion to surround three sides of the flexible locking portion.

4. The shielded connector according to claim 1, wherein the flexible locking portion is provided to be bent to deform in an outer direction of the connector, and wherein the restricting rib is arranged on an outer side of the flexible locking portion.

5. The shielded connector according to claim 4, wherein the restricting rib includes an outer portion arranged on an outer side of the flexible locking portion and a side portion extending from the outer portion to surround three sides of the flexible locking portion.

6. The shielded connector according to claim 1, wherein the restricting rib contacts at least a part of a lip of the engaging hole.

7. The shielded connector according to claim 1, wherein the restricting rib extends substantially parallel to the flexible locking portion with a space therebetween.

8. The shielded connector according to claim 7, wherein the flexible locking portion includes an engaging projection at its distal end that engages a lip of the engaging hole.

9. The shielded connector according to claim 1, wherein the housing includes another flexible locking portion and restricting rib which are received in another engaging hole provided in the shielded shell.

* * * * *